US005624008A

United States Patent [19]

Beardslee, Jr.

[11] Patent Number: 5,624,008

[45] Date of Patent: Apr. 29, 1997

[54] CONVERTIBLE TREE STAND

[76] Inventor: Charles E. Beardslee, Jr., 3057 Pease Dr., Bellevue, Nebr. 68123

[21] Appl. No.: 412,709

[22] Filed: Mar. 29, 1995

[51] Int. Cl.[6] ..... A63B 27/00; E04G 1/00

[52] U.S. Cl. ..... 182/136; 182/187; 182/20

[58] Field of Search ..... 182/136, 135, 182/187, 20, 116

[56] References Cited

U.S. PATENT DOCUMENTS

| | | | |
|---|---|---|---|
| 3,332,698 | 7/1967 | Cafra | 182/187 |
| 3,960,240 | 6/1976 | Cotton | 182/20 |
| 4,009,762 | 3/1977 | Bjerkgard | 182/20 |
| 4,321,982 | 3/1982 | Strickland | 182/20 |
| 4,321,983 | 3/1982 | Nelson | 182/20 X |
| 4,452,338 | 6/1984 | Untz | 182/187 |
| 4,582,165 | 4/1986 | Latini | 182/20 |
| 4,593,789 | 6/1986 | Treants | 182/142 |
| 4,726,447 | 2/1988 | Gibson et al. | 182/135 |
| 5,009,283 | 4/1991 | Prejean | 182/187 X |
| 5,064,020 | 11/1991 | Eagleson | 182/20 |
| 5,253,732 | 10/1993 | Daniels | 182/116 |
| 5,265,780 | 11/1993 | Matthews et al. | 182/187 X |
| 5,282,520 | 2/1994 | Walker | 182/116 |
| 5,295,556 | 3/1994 | Mullin | 182/187 |
| 5,310,019 | 5/1994 | Paul | 182/135 X |
| 5,314,042 | 5/1994 | Adams | 182/187 |
| 5,433,291 | 7/1995 | Shoestock, Sr. | 182/20 |
| 5,482,137 | 1/1996 | McNeill | 182/136 X |
| 5,492,196 | 2/1996 | Michno | 182/20 |
| 5,492,198 | 2/1996 | Williams | 182/136 |

FOREIGN PATENT DOCUMENTS

| | | | |
|---|---|---|---|
| 093000967 | 1/1993 | WIPO | 182/187 |

*Primary Examiner*—Terry Lee Melius
*Assistant Examiner*—Thomas A. Beach
*Attorney, Agent, or Firm*—Zarley, McKee, Thomte Voorhees & Sease; Mark D. Frederiksen

[57] ABSTRACT

The climbing tree stand of the present invention is convertible between a pair of individual and independent frames attachable to a tree trunk for climbing the same, and a cart for transporting equipment or game. The seat frame includes a U-shaped support frame with a blade connected between the ends of the support frame legs, for engagement with a tree trunk. A U-shaped loop has its legs pivotally connected to the support frame legs, and includes a base for engaging a tree trunk opposing the blade. An axle is removably connected to the seat frame and may be repositioned to receive a pair of wheels when the tree stand is converted to a cart configuration. A pair of struts are pivotally connected at their lower ends to the support frame legs, and removably connected at their upper ends to the loop, to support the loop in an inclined position. The struts and support frame include apertures which will be aligned and locked into position by pins, when the tree stand is converted to the cad configuration. The foot frame also includes a U-shaped support frame with a blade connected between the support frame legs, for engaging a tree trunk. The foot frame further includes a loop pivotally connected to the support frame legs and a pair of struts interconnecting the support frame and loop to selectively retain the loop in an inclined position relative to the support frame. Apertures in the foot frame struts and foot support frame are positioned to be aligned when the tree stand is converted to the cart configuration, and locked in position with pins. A pair of pockets are formed in the foot frame in which a pair of wheels are stored when the apparatus is in the tree stand configuration. The wheels are selectively attached to the axle when the tree stand is in the cart configuration.

7 Claims, 5 Drawing Sheets

CONVERTIBLE TREE STAND

TECHNICAL FIELD

The present invention relates generally to tree climbing apparatus for use by hunters and the like, and more particularly to a climbing tree stand which is convertible to a game carrying cart and convertible to a generally flat condition for effective storage.

BACKGROUND OF THE INVENTION

Platforms and tree stands have long been utilized by hunters to permit the hunter to rest in an elevated location within a tree. This is particularly advantageous in bow hunting and the like as the sport of bow hunting has gained popularity, a number of devices have been developed and proposed for enabling a person to ascend and descend a tree quickly and safely. For example, U.S. Pat. No. 5,295,556 discloses a multipurpose hunting cart with a ladder portion affixed to a protecting platform, and a pair of wheels attached to the ladder to form a wheeled cad when utilized in one position, and permitting the ladder to be propped against a tree with the platform connected to the tree, to service a stand, The main drawback of that type of tree stand was in the inability to increase or decrease the height of the platform on the tree. For this reason a climbing tree stand is currently known in the prior art which permits the hunter to ascend and descend a tree trunk. Typically, a climbing tree stand provides a seat frame for supporting the hunter's body, and a foot frame for supporting the hunter's feet and legs. The seat frame and foot frame are typically separate units constructed to encircle a tree trunk and selectively engage the trunk to remain in place on the tree. When the frames are tilted, they are disengaged from the tree so that the frames may be independently permitted to slide vertically along the tree trunk. The hunter can thereby ascend and descend a tree by alternately standing on the foot frame while raising or lowering the seat frame along the tree, and then sitting on the seat frame while raising or lowering the foot frame. One example of such a tree climbing apparatus is found in U.S. Pat. No. 4,452,338.

While each of these prior art devices has its own advantages, to date, the advantageous features of both apparatus have not been combined in a simple and efficient convertible tree stand which also permits climbing and descending a tree trunk.

SUMMARY OF THE INVENTION

It is therefore a general object of the present invention to provide a dual frame tree climbing stand which is convertible to a wheeled cart.

Another object of the present invention is to provide a convertible climbing tree stand which is completely self-contained for easy transport, and which is quickly and simply convertible.

Yet another object is to provide a climbing tree stand which is convertible to minimal dimensions for convenience storage.

These and other objects will be apparent to those skilled in the art.

The climbing tree stand of the present invention is convertible between a pair of individual and independent frames attachable to a tree trunk for climbing the same, and a cart for transporting equipment or game. The seat frame includes a U-shaped support frame with a blade connected between the ends of the support frame legs for engagement with a tree trunk. A U-shaped loop has its legs pivotally connected to the support frame legs, and includes a base for engaging a tree trunk opposing the blade. An axle is removably connected to the seat frame and may be repositioned to receive a pair of wheels when the tree stand is convened to a cart configuration. A pair of struts are pivotally connected at their lower ends to the support frame legs, and removably connected at their upper ends to the loop, to support the loop in an inclined position. The struts and support frame include apertures which will be aligned and locked in position by pins, when the tree stand is converted to the cart configuration. The foot frame also includes a U-shaped support frame with a blade connected between the support frame legs, for engaging a tree trunk. The foot frame further includes a loop pivotally connected to the support frame legs and a pair of struts interconnecting the support frame and loop to selectively retain the loop in an inclined position relative to the support frame. Apertures in the foot frame struts and foot support frame are positioned to be aligned when the tree stand is converted to the cart configuration, and locked in position with pins. A pair of pockets are formed in the foot frame in which a pair of wheels are stored when the apparatus is in the tree stand configuration. The wheels are selectively attached to the axle when the tree stand is in the cart configuration.

DESCRIPTION OF THE PREFERRED EMBODIMENT

Figure 1:
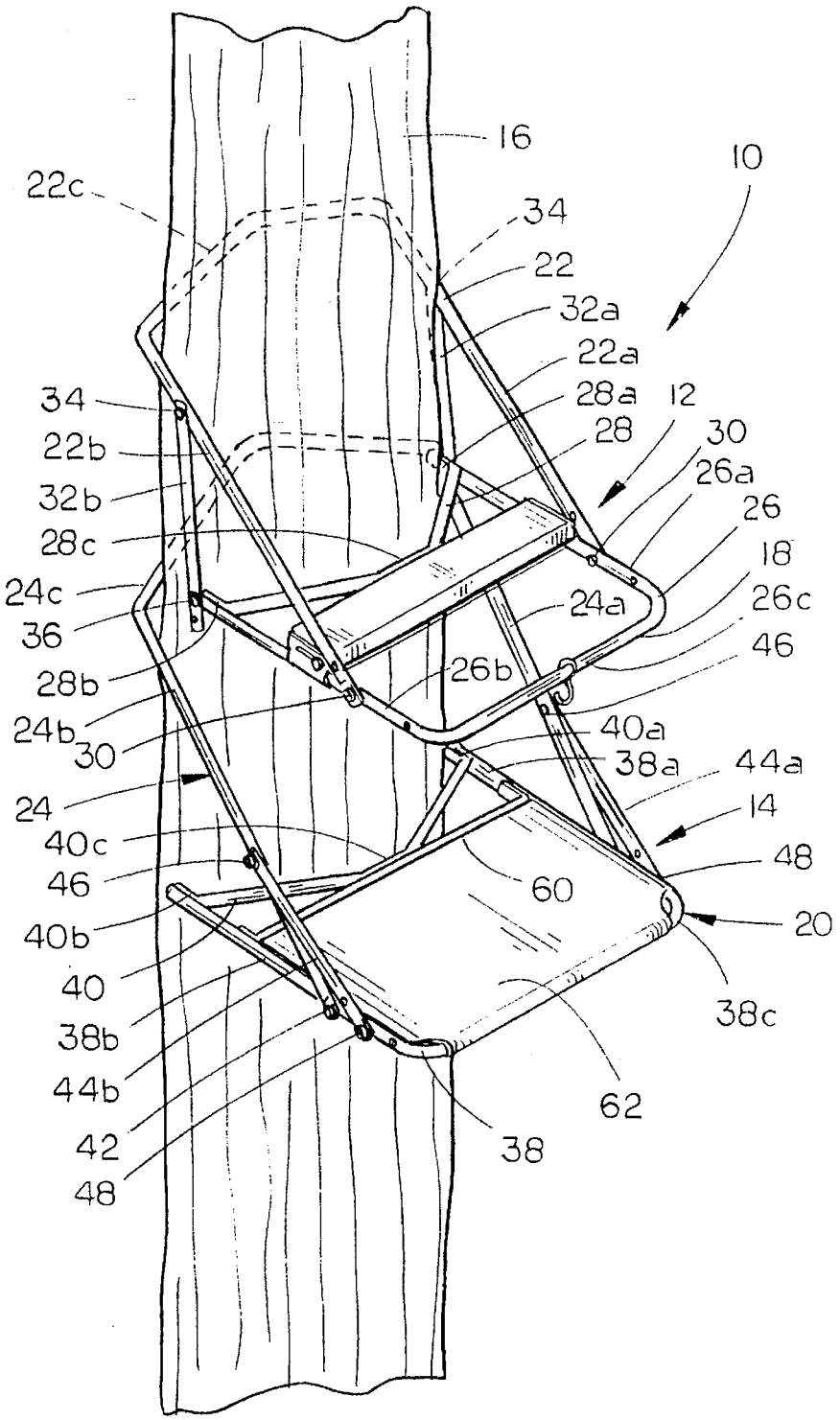
FIG. 1 is a perspective view of the convertible tree climbing stand in the tree climbing orientation and connected to a tree.

Referring now to the drawings, in which similar or corresponding parts are identified with the same reference numeral, and more particularly to FIG. 1, the convertible climbing tree stand of the present invention is designated generally at 10 and includes a seat frame 12, upon which a hunter will sit, and a foot frame 14, upon which a hunter will rest his feet, both operably connected to a tree 16.

Both seat frame 12 and foot frame 14 include a support frame 18 and 20 respectively and an inclined loop 22 and 24 respectively connected to their respective support flames, The seat support frame 18 includes a generally U-shaped main member 26 having a pair of parallel legs **26*a* and 26*b* with a base 26*c* connected between one end of legs 26*a* and 26*b*. An arch-shaped tree engaging blade 28 has projecting legs 28*a* and 28*b* connected to the projecting ends of main member legs 26*a* and 26*b* respectively, and a central base portion 28*c* interconnecting legs 28*a* and 28*b*. As shown in FIG. 1, blade 28 has an arch-shape which will engage the trunk of a tree 16**.

Inclined loop 22 is also a generally U-shaped member having a pair of generally parallel legs 22*a* and 22*b* interconnected by an arch-shaped base 22*c*. Loop base 22*c* is curved or bent so as to engage a tree trunk 16, in opposition to blade 28 on support frame 18. The projecting ends of loop legs 22*a* and 22*b* are pivotally connected to main member legs 26*a* and 26*b* by pins 30. Loop 22 is connected to main member 26 intermediate the ends of main member legs 26*a* and 26*b*.

A pair of vertical struts 32*a* and 32*b* have upper ends removably connected to loop legs 22*a* and 22*b* by pins 34, and lower ends pivotally connected to the projecting ends of main member legs 26*a* and 26*b* at pivot pins 36. Struts 32*a* and 32*b* thereby form cross-members between inclined loop 22 and support frame 18 to rigidly support loop 22 in the inclined position relative to support frame 18.

The foot support frame 20 is constructed similarly to seat support frame 18, with support frame 20 having a U-shaped main member 38 with legs 38*a* and 38*b* connected by a base 38*c*. An arch-shaped blade 40 includes a pair of legs 40*a* and 40*b* connected to the projecting ends of main member legs 38*a* and 38*b* respectively, and a central base portion 40*c*.

The foot frame inclined loop 24 is a U-shaped member with legs 24*a* and 24*b* interconnected by an arch-shaped base 24*c*, similar to seat frame loop 22. Foot frame loop 24 is connected intermediate the ends of main member legs 38*a* and 38*b* by removable pins 42 through the projecting ends of loop legs 24*a* and 24*b*. A pair of struts 44*a* and 44*b* have an upper end pivotally connected to loop legs 24*a* and 24*b* respectively by removable pins 46, and are pivotally connected at their opposing ends by pivot pins 48. The lower ends of struts 44*a* and 44*b* are pivotally connected at pivot pins 48 intermediate pins 42 and main member base 38*c*, to form a cross-member rigidly holding loop 24 in an inclined position relative to support frame 20.

Figure 2:
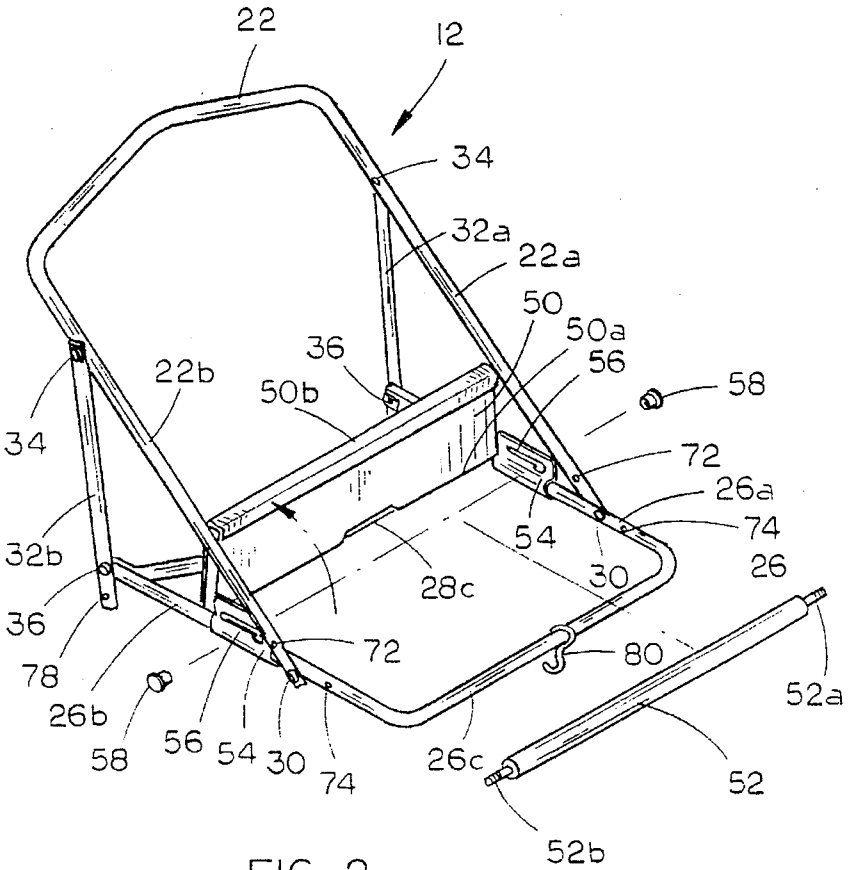
FIG. 2 is a perspective view of the seat frame showing the first step in converting the tree stand to a can.

Referring now to FIG. 2, seat frame 12 is shown in more detail. A seat 50 is shown pivotally connected along a rearward edge 50*a* to the blade base 28*c*. The forward edge 50*b* is supported on an axle 52 which extends between a pair of brackets 54 mounted on main member legs 26*a* and 26*b*. Axle 52 has a pair of coaxial shafts 52*a* and 52*b* projecting from the ends thereof to permit journaling through slots 56 in brackets 54. The ends of shaft 52*a* and 52*b* are threaded to receive end caps 58 which will hold axle 52 in position on brackets 54.

Figure 3:
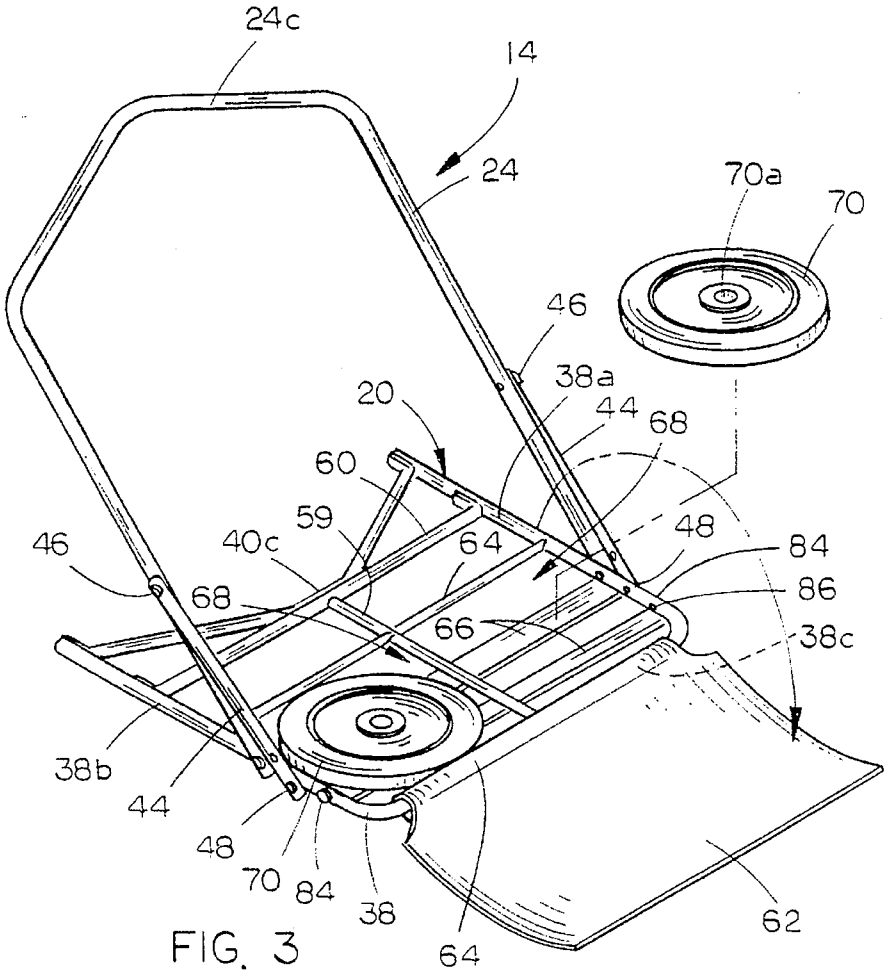
FIG. 3 is a perspective view of the foot stand showing one step in converting the tree stand to a cart.

Referring now to FIG. 3, foot frame 14 is shown in more detail. Support frame 20 includes a divider 59 extending between blade base 40c and main member base 38*c*, midway between and parallel to main member legs 38*a* and 38*b*. A crossbar 60, extending between main member legs 38*a* and 38*b* and tangent to blade base 40*c* forms a rearward support edge for a flap 62 pivotally connected to main member base 38*c*. Flap 62 is preferably a heavy fabric with a sleeve 64 formed along one edge through which main member base 38*c* is journaled, such that flap 62 may be pivoted to extend to crossbar 60, as shown in FIG. 1. A pair of straps have their ends connected to crossbar 60 so as to form loops, (not shown). The loops permit a hunter to raise the foot frame 14 by journaling his feet through the loops.

An auxiliary crossbar 64 extends between main member legs 38*a* and 38*b* parallel to crossbar 60 and intermediate crossbar 60 and main member base 38*c*. A pair of straps 66 extending between main member legs 38*a* and 38*b* are located on the bottom of support frame 20 and located between auxiliary cross member 64 and main member base 38*c* to form a supporting bottom in a pair of "pockets" designated generally at 68. Pockets 68 are defined by divider 59 (which separates the pockets), main member legs 38*a* and 38*b* forming two opposing sides, auxiliary crossbar 64 and main member base 38*c* forming the second pair of opposing sides, straps 66 forming a bottom, and flap 62 forming a top. A pair of wheels 70 are stored within pockets 68, and which are utilized to form the two-wheeled cart, as described in more detail hereinbelow.

Figure 4:
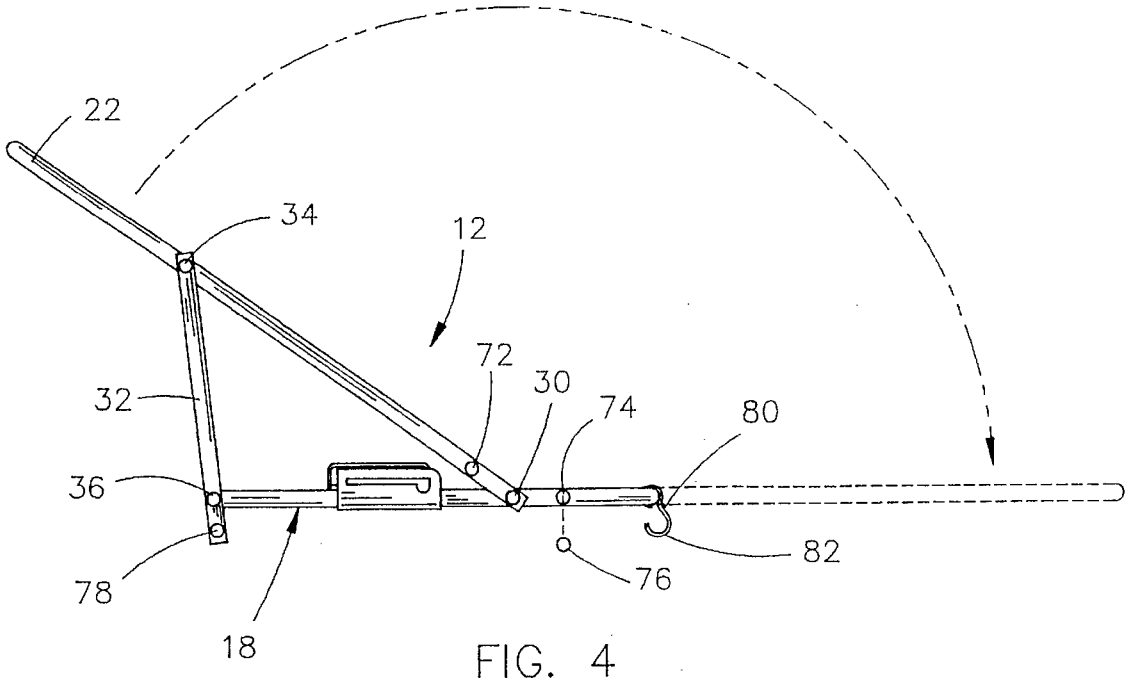
FIG. 4 is a side elevational view of the seat frame showing a second step in converting the tree stand.

Referring once again to FIG. 2, the initial step in converting the climbing tree stand to a two-wheel cart, includes raising seat 50 and removing axle 52 from between brackets 54, and retaining caps 58 for further use with axle 52. Referring now to FIG. 4, pins 34 are removed to disconnect struts 32 from loop 22, thereby permitting pivotal movement of loop 22 about pivot pins 30. As shown in FIGS. 2 and 4, a set of apertures 72 in loop legs 22*a* and 22*b* proximal pivot pins 30 will align with a pair of apertures 74 formed in main member legs 26*a* and 26*b* when loop 22 is pivoted to a position coplanar with support frame 18. A pair of removable pins 76 are journaled through the aligned apertures 72 and 74 to retain loop 22 in the coplanar position with support frame 18.

It should be noted that struts 32 are pivotally mounted intermediate their ends, such that a lower end projects beyond support frame 18. A pair of apertures 78 formed in the projecting ends of struts 32 will be utilized in a manner described in more detail hereinbelow. Similarly, a hook member 80 is pivotally connected to main member base 26*c*, with a hook 82 dimensioned to receive and retain the base 24*c* of foot frame loop 24, as shown in FIG. 8.

Referring now to FIG. 3, flap 62 is opened to permit access to wheels 70 in pockets 68. Wheels 70 are removed for later use, and flap 62 is returned to its original position. A set of pins 84 are removed from a pair of apertures 86 located intermediate pivot pins 48 and main member base 38*c*. Pins 46 are then removed from the upper end of struts 44 to permit pivotal movement of struts 44 and pivotal movement of loop 24.

Figure 5:
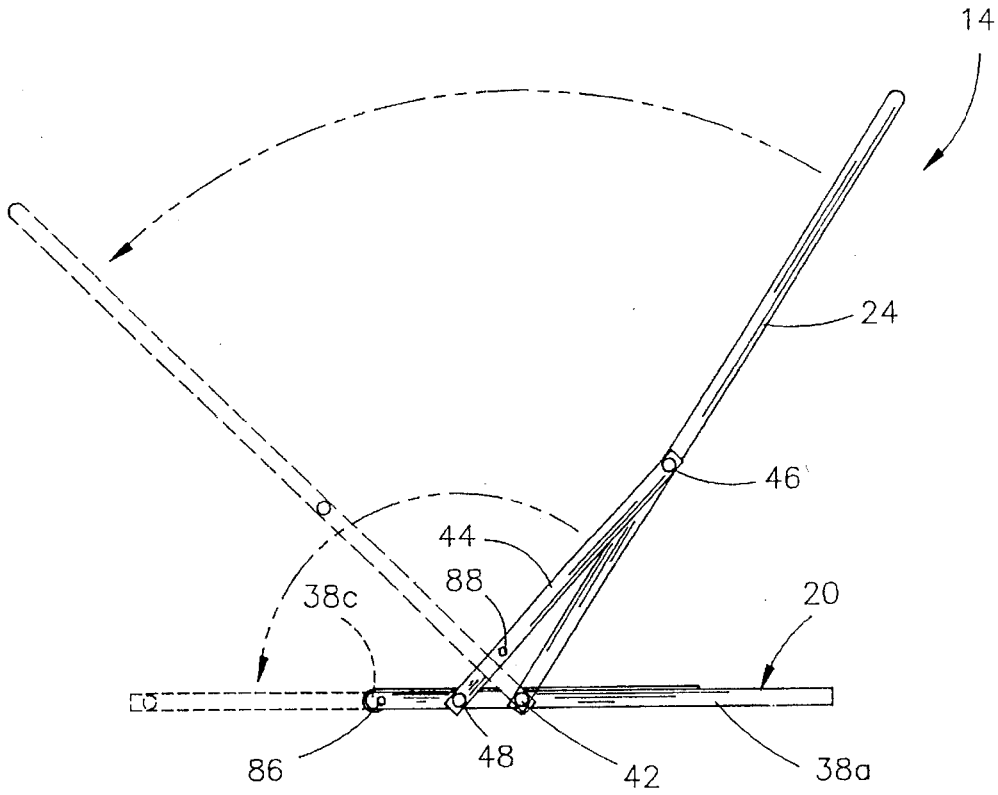
FIG. 5 is a side elevational view of the foot stand showing a second conversion step.

Referring now to FIG. 5, it should be noted that foot frame 14 is reversed in orientation from the orientation shown in FIG. 3. Once pins 46 are removed, loop 24 is pivoted on pivot pins 42 towards main member base 38*c*, while struts 44 are pivoted on pivot pins 48 to a position coplanar with support frame 20. Each strut 44 has an aperture 88 formed therein intermediate the ends thereof which will align with apertures 86 in main member legs 38*a* and 38*b*, once struts 44 are pivoted to the coplanar position shown in broken lines in FIG. 5. Pins 84 are then reinserted through the coaxial apertures to hold struts 44 in a plane coplanar with frame 20, as shown in FIG. 6.

Figure 6:
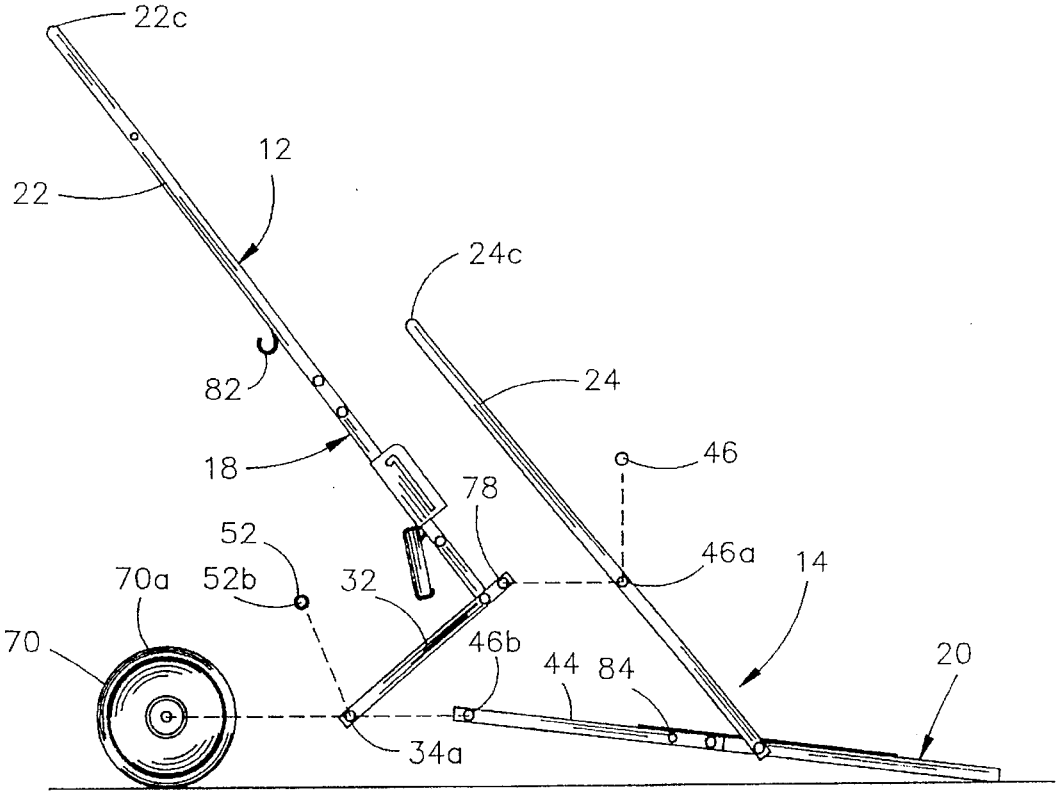
FIG. 6 is a side elevational view of the seat and foot frames showing the interconnection thereof to form a cart.
Figure 7:
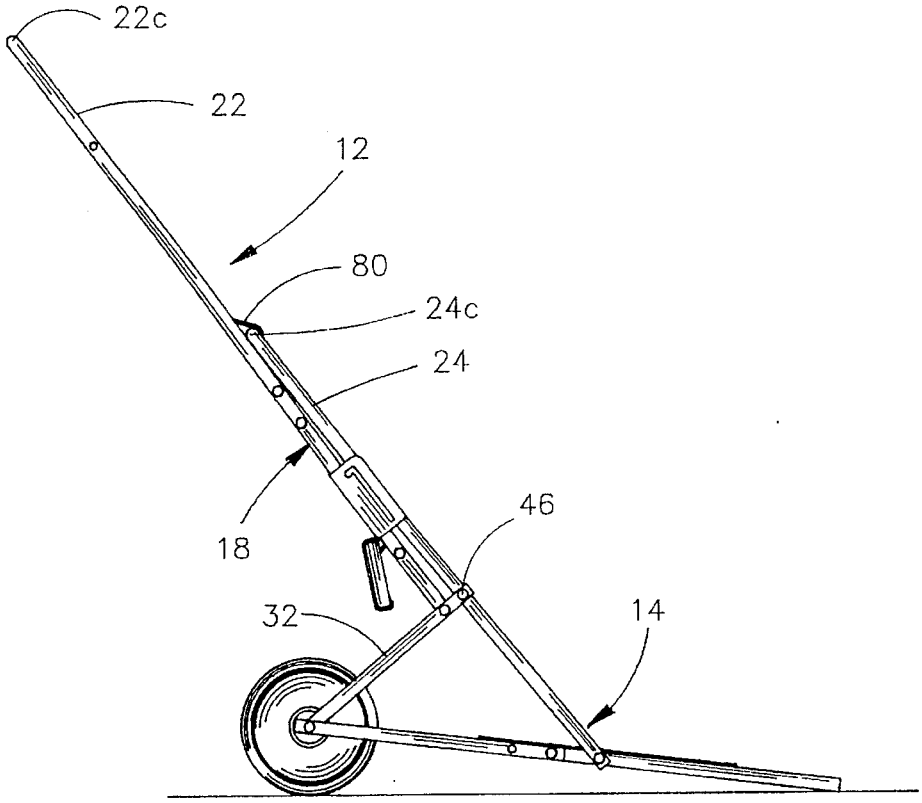
FIG. 7 is a side elevational view of the two-wheeled cart.
Figure 8:
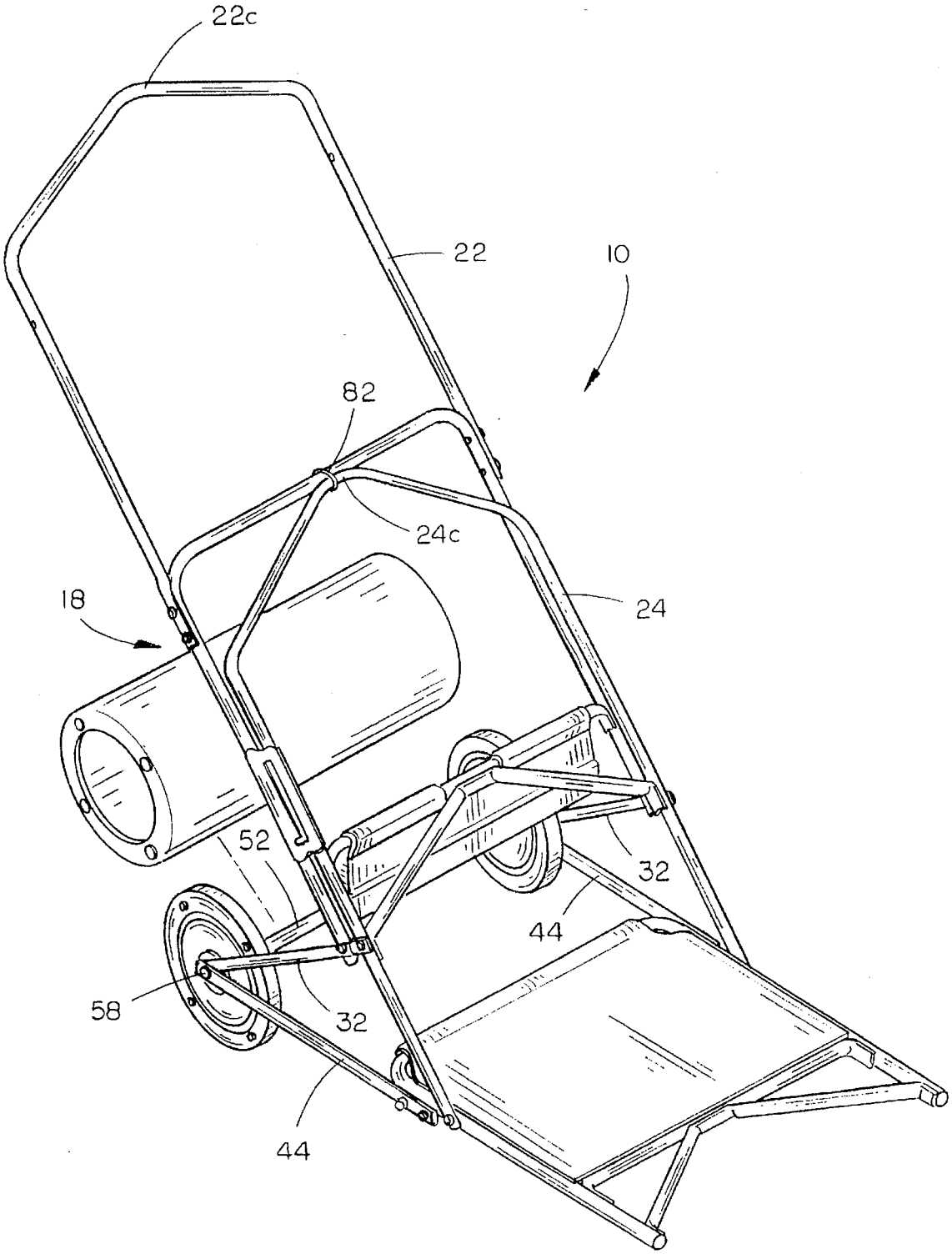
FIG. 8 is a perspective view of the two-wheeled cart formed by converting the tree stand.

Referring now to FIGS. 6–8, seat frame 12 is repositioned with loop base portion 22*c* oriented upwardly and seat frame struts 32 extending downwardly and rearwardly from seat support frame 18. Loop 24 of foot frame 14 is then positioned with in apertures 46*a* aligned with apertures 78 in the projecting ends of struts 32. Pins 46 are inserted to interconnect foot frame 14 with seat frame 12, as shown in FIGS. 7 and 8. Main member base portion 24*c* is retained by hook 82 of hook member 24 such that loop 24 is parallel and affixed to loop 22, also shown in FIGS. 7 and 8.

Axle 52 is then inserted through the hub apertures 70*a* of wheels 70, thence through apertures 34*a* in the ends of seat frame struts 32, and thence through apertures 46*b* in the ends of foot frame struts 44. Caps 58 are then threaded on the ends of the shafts 52*a* and 52*b* (shown in FIG. 2) to retain the wheels and assembly in position. At this point, tree stand 10 may be utilized as a two-wheel cart or litter to haul game or equipment.

As shown in FIG. 8, a flexible tubular member 90 is provided as an accessory item which may be attached between wheels 70 for situations where the wheels may sink into soft soil or mud. Each end 90*a* and 90*b* of tubular member 90 is provided with a plurality of fastener caps 92*a* which cooperate with fastener bases 92*b* around the periphery of each wheel 70. When pulled taut between wheels 70, tubular member 90 acts as a roller to broaden the support surface on the ground. Tubular member 90 is preferably formed of a flexible foldable material which may be folded flat for storage on top of wheels 70 under flap 62 on foot frame 14.

Whereas the invention has been shown and described in connection with the preferred embodiment thereof, many modifications, substitutions and additions may be made which are within the intended broad scope of the appended claims.

I claim:

1. A tree stand convertible into a cart, comprising:

a seat frame and a foot frame, each individually and independently attached to a tree trunk for climbing the tree trunk and operably connectable to form a cart; said seat frame comprising:

a U-shaped support frame having a base and a pair of legs projecting from ends of the base;

a blade for engaging a tree trunk connected between projecting ends of said frame legs;

a U-shaped loop having a tree trunk engaging base portion and a pair of legs with projecting ends pivotally connected to said support frame legs proximal the support frame base;

a seat having forward and rearward ends, pivotally connected along its rearward end to said blade;

an axle removably connected between said support frame legs to support the forward end of said seat;

a pair of caps selectively retaining said axle in place between said support frame legs;

a pair of struts having first and second ends, pivotally connected proximal to but spaced from their first ends to the projecting ends of the support frame;

each said strut having an opening in the second end for receiving one end of said axle;

said struts removably connected at their second end openings to said loop legs to selectively support the loop at an incline relative to the support frame legs;

said strut first ends having an aperture therein for removable connection to said foot frame;

a pair of forward apertures in the support frame legs between the support frame base and the pivotal connection of the loop to the support frame, a pair of apertures in said loop legs located for alignment with the forward apertures when the loop is pivoted to a position co-planar with the support frame legs and means for selectively fastening the loop apertures aligned with the forward apertures when the loop is co-planar with the support frame legs;

said foot frame comprising:

a U-shaped support frame having a base and a pair of legs projecting from ends of the base;

a blade for engaging a tree trunk connected between projecting ends of the support frame legs;

a U-shaped loop having a tree trunk engaging base and a pair of legs with projecting ends pivotally connected to the support frame legs proximal the support frame base;

a pair of intermediate apertures located on the loop legs between the base and the leg ends for removable connection of the loop to the seat frame strut first end apertures;

a pair of struts having first and second ends, pivotally connected at their first ends to the support frame legs intermediate the support frame base and the pivotal connection of the loop to the support frame, and removably connected at their second ends to the loop at said intermediate apertures, to selectively support the loop at an incline relative to the support frame legs;

each said strut having an intermediate aperture therein located between the first and second ends;

a pair of forward apertures in the support frame legs proximal the base and spaced from the pivotal connection of the strut first ends for alignment with the strut intermediate apertures when the loop is pivoted to a position co-planar with the support frame legs, and means for selectively fastening the loop in a position co-planar with the support frame legs, journaled through the forward aperture and strut intermediate apertures;

a pair of wheels selectively and removably stored in said frame pockets, having hub apertures for receiving the ends of said axle; and a hook member pivotally mounted on said seat frame support frame base, with an attachment hook sized to selectively retain the foot frame loop base therein when the tree stand is configured as a cart.

2. The convertible tree stand of claim 1, wherein said foot frame pockets include an upper wall formed of a fabric flap pivotally connected along one edge to the foot frame base.

3. The convertible tree stand of claim 1, wherein said foot frame pockets include:

a divider extending between the center of the foot frame blade and the center of the foot frame support frame base, to form a common side wall between said pockets;

said foot frame support frame legs forming second side walls, parallel the common side wall, of said pockets;

said foot frame support frame base forming a third side wall for both pockets;

said foot support frame legs and base having upper and lower surfaces, and said divider having upper and lower surfaces; and a strap mounted to the lower surfaces of said foot support frame legs and the divider lower surface, forming a lower wall of said pockets.

4. The convertible tree stand of claim 3, wherein said foot frame pockets include an upper wall formed of a fabric flap pivotally connected along one edge to the foot frame base.

5. The convertible tree stand of claim 3, further comprising a crossbar mounted between said foot support frame legs generally parallel to the foot support frame base, to form a fourth side wall for both pockets.

6. The convertible tree stand of claim 1, further comprising a tubular member having first and second ends and an inside diameter substantially the same as the diameter of the wheels and first and second sets of cooperable fasteners, the first set having a first half mounted on one of said wheels and a second cooperable half mounted on the tubular member first end, the second set having a first half mounted on the other of the wheels and a second cooperable half mounted on the tubular member second end.

7. The convertible tree stand of claim 6, wherein said tubular member is formed of a flexible material which may be folded and stored in said pockets.

* * * * *